United States Patent [19]

Berfield

[11] 4,435,877

[45] Mar. 13, 1984

[54] NOISE REDUCING MEANS FOR VACUUM CLEANER

[75] Inventor: Robert C. Berfield, Jersey Shore, Pa.

[73] Assignee: Shop-Vac Corporation, Williamsport, Pa.

[21] Appl. No.: 429,446

[22] Filed: Sep. 30, 1982

[51] Int. Cl.[3] ..... A47L 9/00

[52] U.S. Cl. ..... 15/326; 55/276; 181/231; 417/312

[58] Field of Search ..... 15/326; 55/276; 417/312; 181/231

[56] References Cited

U.S. PATENT DOCUMENTS 3,609,946 10/1971 Nakagawa et al. ..... 15/326 X 4,195,969 4/1980 Whitney ..... 417/312 X 4,330,899 5/1982 Miller et al. ..... 15/326

4,356,591 11/1982 Lude ..... 15/326

*Primary Examiner*—Chris K. Moore

*Attorney, Agent, or Firm*—Ostrolenk, Faber, Gerb & Soffen

[57] ABSTRACT

A noise muffler for a vacuum cleaner is constructed of flexible open cell foam inserts, one of which extends across an opening through which working air flows between two plenums. At this opening the foam insert is provided with a plurality of relatively large perforations. Similar perforations may be provided at the ends of the other insert, this other insert being in the downstream plenum.

8 Claims, 8 Drawing Figures

3
34
33
33
10
13
15
19
97
97
13
12
21
13
3

19
21
10
15
34
12
13
13
31
29
11

NOISE REDUCING MEANS FOR VACUUM CLEANER

This invention relates to tank-type electric motor-operated vacuum cleaners, and more particularly relates to means for reducing noise attributable to air flow.

In electric motor-operated vacuum cleaners, noise levels are often objectionable because of vibrations of the motor and working fan and because of air moving at relatively high speed. U.S. Pat. No. 2,814,064, issued Nov. 26, 1957 to J. C. Montgomery, entitled "Anti-Chattering Air Supported Cleaner" is concerned with the reduction of noise due to motor and fan vibrations, while the instant invention as well as U.S. Pat. No. 4,330,899, issued May 25, 1982 to J. Miller et al, entitled "Noise Reducing Blower Motor Housing Means for Vacuum Cleaner, or the Like", U.S. Pat. No. 3,599,273, issued Aug. 17, 1971 to K. Shirayanagi, entitled "Vacuum Cleaner", and U.S. Pat. No. 2,962,118, issued Nov. 29, 1960 to W. Lee et al, entitled "Electric Vacuum Cleaner" disclose means for reducing noise attributable to air flow.

Many so-called bypass type vacuum cleaners include a tank having a lid forming a removable closure for the top opening of the tank. This lid also mounts a housing for the fan impeller, which housing supports the motor, and a molded insulating housing for the motor. As described in the aforesaid U.S. Pat. No. 4,330,899, the motor housing is provided with internal partitions that separate motor cooling air generated by an auxiliary fan from mixing with the working air that is generated by the main fan. In addition, housing partitions are provided to define plenums where the velocity of working air flow is reduced before the working air is discharged from the motor housing. Even though air velocity is reduced in these plenums, considerable noise attributable to air flow is still present.

In order to overcome the foregoing problem, the primary step taken by the instant invention is to provide a sound muffler in the form of a barrier extending across the opening that series connects plenums on the downstream side of the main fan. This barrier is a strip of foam that is provided with a plurality of relatively large perforations aligned with the opening in the partition. Air flow entering the downstream plenum impinges on the center of another strip of sound muffling foam material, where the air splits and flows toward opposite ends of the latter strip before being discharged from the second plenum.

If the barrier is constructed of open cell type foam, even without having large perforations, the barrier will act to muffle noise. However, if the main dust filter upstream of the main fan is faulty or is installed improperly, excessive amounts of particles will reach the barrier, lodging therein and plugging the cells thereof. This will reduce air flow, thereby reducing effectiveness of the vacuum cleaner. The relatively large perforations are of a size sufficient to permit large particles to pass through the foam barrier, thereby permitting the vacuum cleaner to continue functioning as intended.

Accordingly, the primary object of the instant invention is to reduce noise attributable to the high velocity flow of working air in a motor operated device, such as a bypass-type vacuum cleaner.

Another object is to provide an effective and inexpensive noise muffling means for a vacuum cleaner or the like.

Another object is to provide a noise muffling means of this type that is constructed of foam material having strategically located relatively large perforations.

A further object is to provide a noise muffling means of this type that is constructed of open cell foam material.

These objects, as well as other objects of this invention, shall become radially apparent after reading the following description of the accompanying drawings in which.

Figure 7:
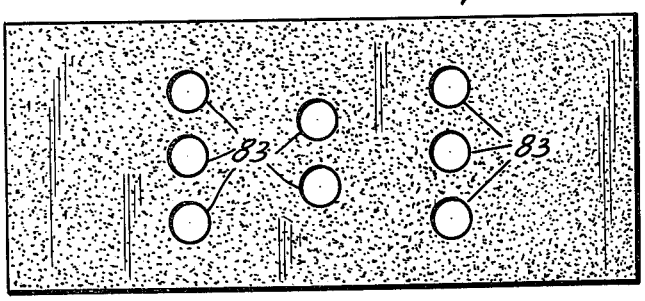
FIG. 7 is a side elevation of the main sound muffling element.
Figure 7A:
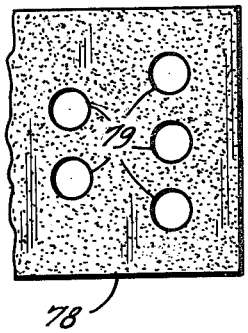

FIG. 7*a* is a fragmentary side elevation showing one end of a modified version of the secondary sound muffling element.

Figure 2:
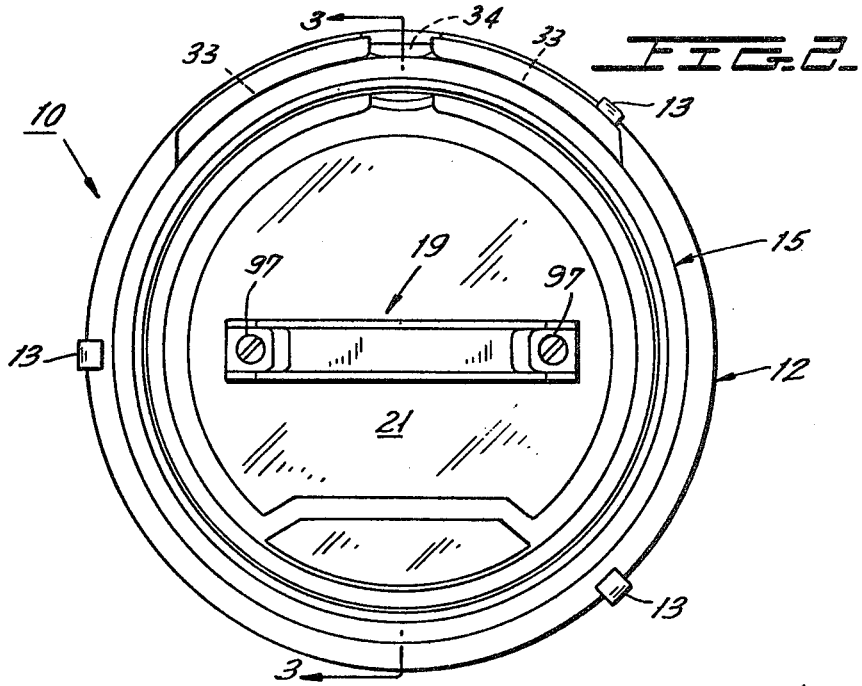
FIG. 2 is a plan view of the vacuum cleaner of FIG. 1.
Figure 1:
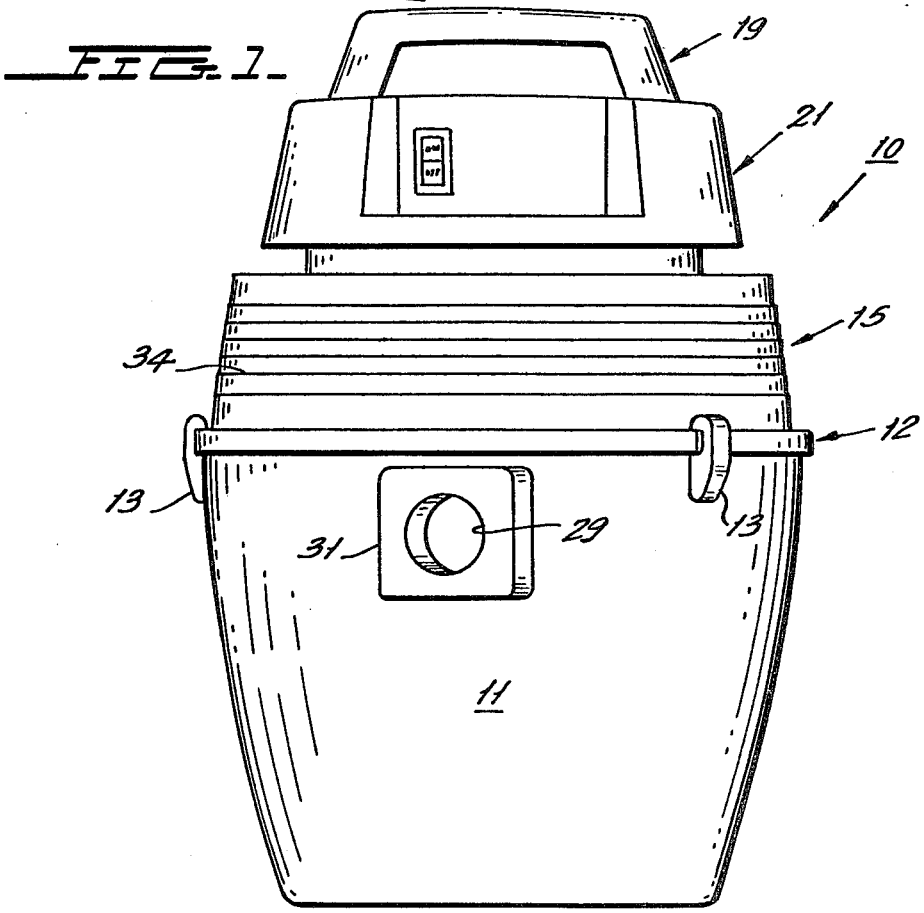
FIG. 1 is a side elevation of a bypss-type vacuum cleaner having the instant invention incorporated therein.
Figure 3:
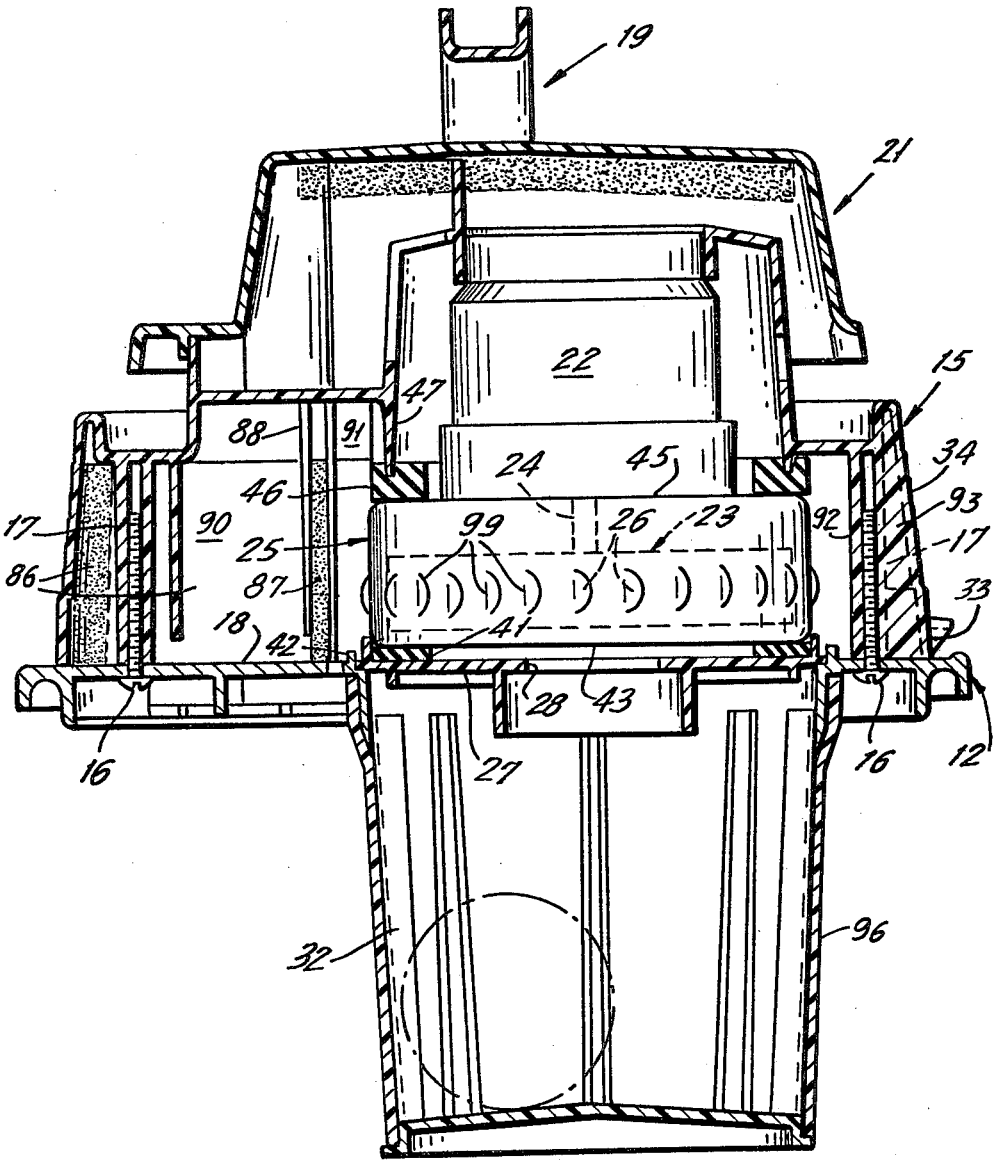
FIG. 3 is a cross-section taken through line 3—3 of FIG. 2, looking in the direction of arrows 3—3, with the collecting tank removed.
Figure 4:
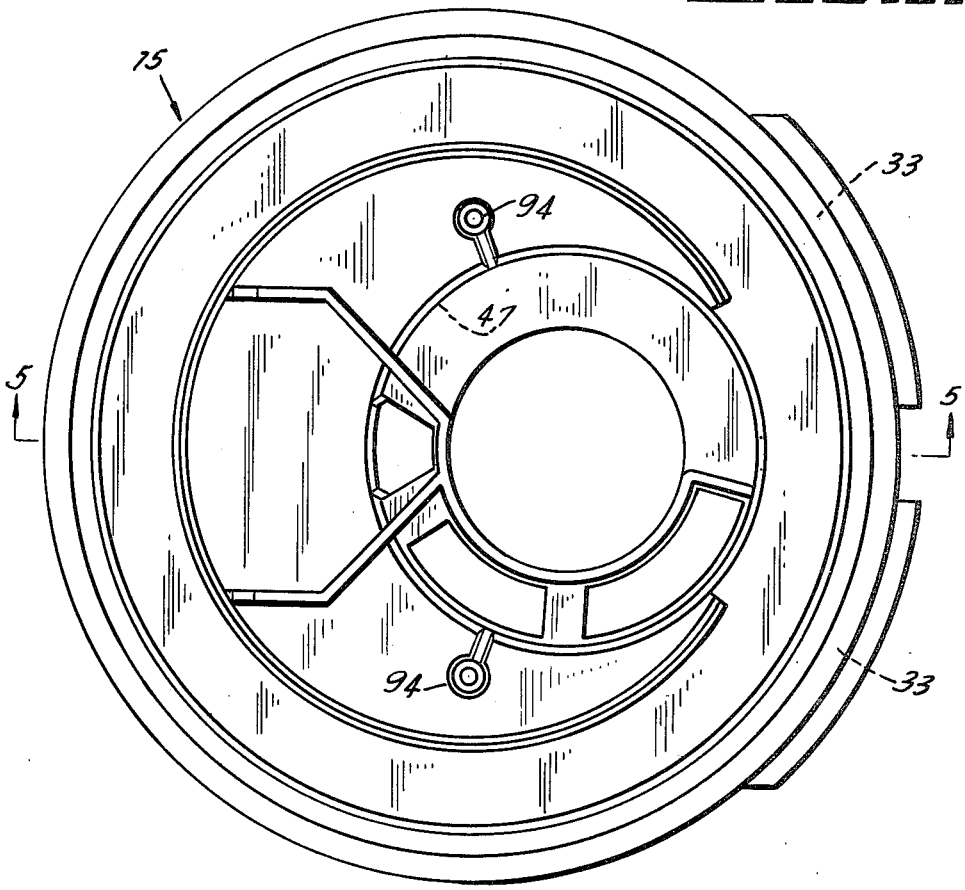
FIG. 4 is a plan view of the motor housing looking in the direction of arrows 4—4 of FIG. 5.
Figure 5:
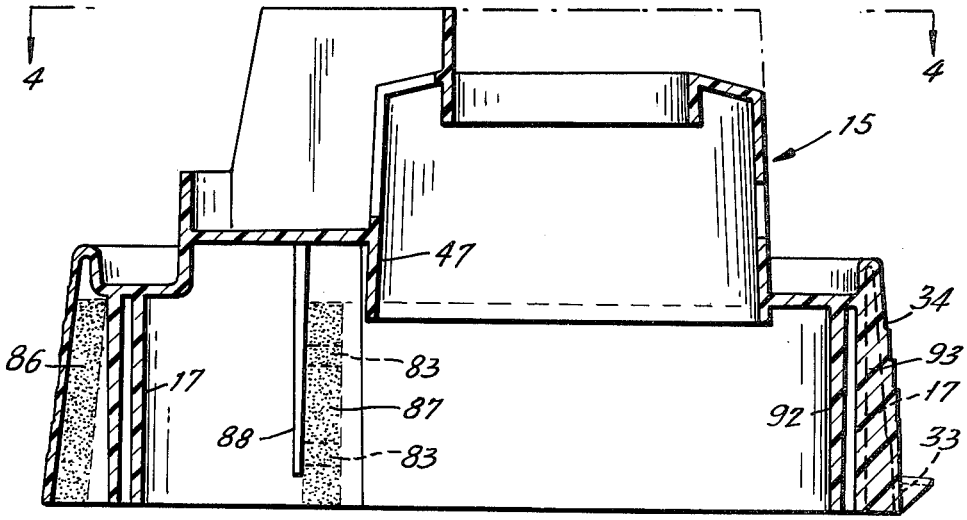
FIG. 5 is a cross-section of the motor housing and sound muffling elements taken through line 5—5 of FIG. 4 looking in the direction of arrows 5—5.

Now referring to the Figures. Vacuum cleaner 10 includes tank 11 that is free-standing on its lower end. Buckle type clamps 13 removably secure lid 12 over the open top of tank 11. Screws 16 retain molded plastic insulating motor housing 15 in operative position on upper surface 18 of lid 12 by extending through clearance apertures in the latter and being threadably received within central bores in six posts 17 formed integrally with housing 15. Two screws 97 extend through clearance apertures at opposite ends of molded plastic handle 19, extend through clearance apertures in the top of molded plastic insulating cover 21 and are threadably received in upwardly facing bores 94 (FIG. 4) of housing 15 to secure handle 19 and cover 21 to motor housing 15 in the operative positions shown in FIGS. 1 and 2.

Disposed within housing 15 and positioned above lid 12 is an assembly that includes electric motor 22, pancake type fan impeller 23 keyed to output shaft 24 of motor 22, and shallow round fan housing 25 which operatively supports motor 22 and impeller 23. The round sidewall of housing 25 is provided with a plurality of louvered apertures 26 through which air is driven from housing 25 by impeller 23. The outer portion of lid 12 is constructed of metal and defines an off center circular aperture, most of which is covered by molded plastic insert 27. The latter is provided with central aperture 28 aligned with a central aperture (not shown) in the lower surface of housing 25 at the center thereof.

Figure 6:
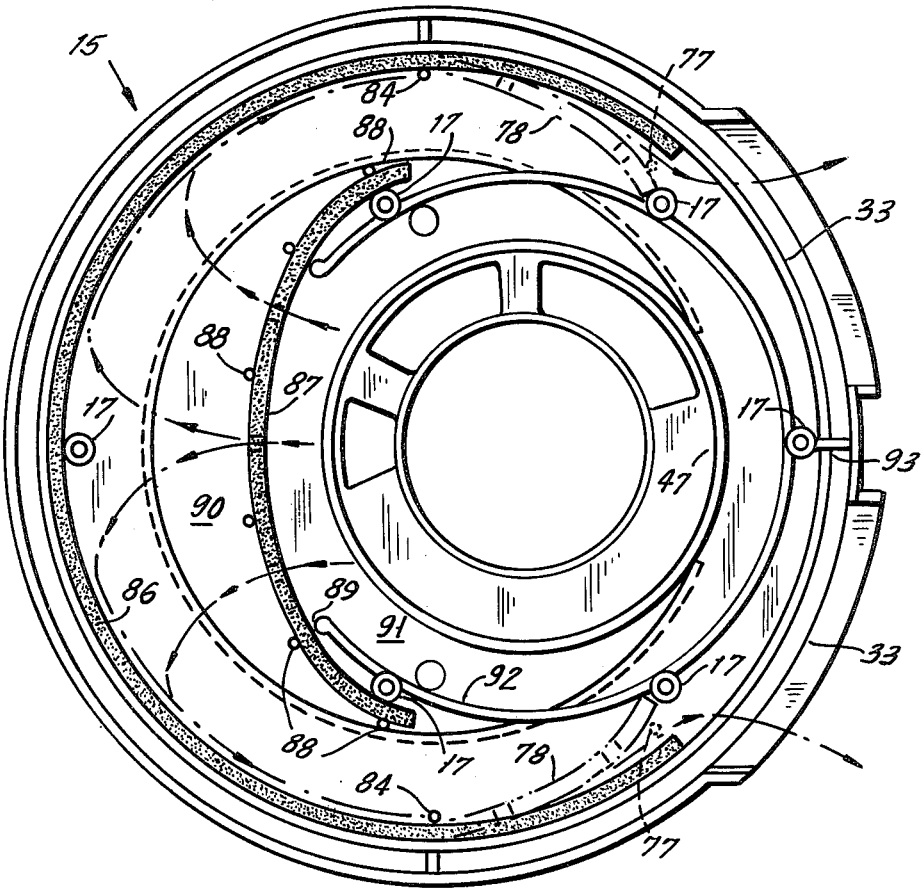
FIG. 6 is a bottom view of the elements of FIG. 5 looking in the direction of arrows 6—6.

In a manner well known to the art, rotation of impeller 23 by motor 22 draws air into tank 11 at the side thereof through aperture 29 in hose fitting 31, through primary dust filter 96 on the outside of circular cage 32 extending downward from lid 12, through lid aperture 28 and the aperture aligned therewith in the bottom wall of housing 25 to the central region of impeller 23, is directed outward (sideways) by impeller 23 through housing apertures 26, redirected by louvres 99 in front of apertures 26 to flow generally tangentially and finally, sideways through exhaust openings 33, 33, at the side 34 of housing 15 where the latter meets lid 12, after expanding in plenums 90, 91 that are defined principally by internal partitions of housing 15. Housing partition 93 (FIG. 6) separates the near ends of exhaust openings 33, 33. In a manner well known to the art, an auxiliary fan blower connected to motor shaft 24 at the end thereof opposite impeller 23 forces cooling air downward across motor 22 with this cooling air flow being isolated from the air flow produced by impeller 23.

Cemented to the bottom surface 43 of housing 25 is relatively thin ring-shaped rubber-like gasket 41 and cemented to upper surface 45 of housing 25 is relatively thick gasket 46, also in the shape of a ring. When vacuum 10 is being assembled, the assembly including motor 22, impeller 23 and housing 25 is supported by lid 12 in a position such that the flat bottom surface of gasket 41 rests against the flat upper surface of lid insert 27. Upwardly extending annular lip 42 of insert 27 surrounds gasket 41 and facilitates positioning thereof concentric with opening 28. Thereafter, motor housing 15 is placed over motor 22 and the elements assembled therewith. As screws 16 are tightened to draw housing 15 downward, the lower free edge of circular partition 47 in housing 15 is drawn against the upper surface of gasket 46 so that, effectively, impeller housing 25 is clamped between wall 47 and lid insert 27, lightly compressing gaskets 41 and 46. This light compression notwithstanding, there is sufficient friction established at the interface between gsket 41 and lid insert 27 to prevent rotational movement of housing 25 when motor 22 starts up, as well as during shipping and other handling of vacuum 10.

Arcuate partition 92 of motor housing 15 surrounds fan housing 25 and forms a boundary for plenum 91 which receives working air that is discharged through openings 26. A discontinuity in partition 92 defines opening 89 through which working air flows from plenum 91 to plenum 90, the latter being outboard of the former.

Primary muffler section 87 is a flexible open-cell foam insert that is positioned over opening 89 by the free ends of partition 92, two of the posts 17 and six internal pins 88 formed integrally with housing 15. Secondary muffler section 86 is trapped between the outer wall of housing 15, one of the posts 17 and two internal pins 84 formed integrally with housing 15.

Both muffler sections 86 and 87 are elongated strip inserts of flexible foam material preferably of the open cell type. The mid-region of section 87 is provided with eight relatively large perforations 83 that are aligned with partition opening 89. Working air leaving upstream plenum 91 flows through muffler section 87 into downstream plenum 90 and impinges on the mid-region of muffler section 86. At this point the air flow splits into two parts which flow in opposite directions across the inner surface of section 86 toward and past the ends thereof, and then through exhaust openings 33, 33.

Even more effective noise muffling may be obtained by providing a plurality of relatively large perforations (such as the five perforations 79 of FIG. *7a*) at each end 78 of the secondary filter 86. As illustrated in phantom in FIG. 6, in this construction pins 77 formed integrally with housing 15 are used to position ends 78 spaced inwardly from the inner wall of housing 15 and against the outside of partition 92. This assures that working air will flow through the perforated ends 78 of the secondary section 86 before reaching exhaust openings 33, 33.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A vacuum cleaner including a bypass-type blower motor, a main blower fan connected to said motor and driven thereby to create a stream of working air, a dust filter located in said stream and upstream of said fan, said stream also extending through first and second plenums disposed downstream of said fan with said second plenum being downstream of said first plenum, partition means defining said plenums and including a first partition separating said plenums, said first partition having an opening through which said working air flows from said first plenum to said second plenum, sound muffler means including a section extending across said opening and through which said working air flows in leaving said first plenum and entering said second plenum, said section being constructed of foam material and having a plurality of relatively large perforations aligned with said opening.

2. A vacuum cleaner as set forth in claim 1 in which the muffler means also includes another section disposed inside said second plenum and positioned so that working air flowing through said section impinges upon a face of said another section at the central region thereof and divides to flow toward opposite ends of said another section and be discharged from said second plenum through exhaust opening means thereof.

3. A vacuum cleaner as set forth in claim 1 or 2 in which the foam material is of the open cell type.

4. A vacuum cleaner as set forth in claim 1 or 2 in which said first partition is generally arcuate.

5. A vacuum cleaner as set forth in claim 2 in which said first and second sections comprise respective first and second sheet members.

6. A vacuum cleaner as set forth in claim 5 in which the second sheet member is elongated and each end thereof is provided with a plurality of relatively large perforations through which said working air flows prior to reaching said exhaust opening means.

7. A vacuum cleaner as set forth in claims 5 or 6 in which said sheet members are flexible inserts retained in generally arcuate configurations.

8. A vacuum cleaner as set forth in claim 1 in which sid first partition is arcuate.

* * * * *